US006943492B2

(12) United States Patent
Miura et al.

(10) Patent No.: US 6,943,492 B2
(45) Date of Patent: Sep. 13, 2005

(54) LIGHT WEIGHT FLAT PANEL IMAGE DISPLAY DEVICE

(75) Inventors: Tokutaka Miura, Kanagawa (JP); Mitsutoshi Hasegawa, Kanagawa (JP); Kazuya Shigeoka, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/200,404

(22) Filed: Jul. 23, 2002

(65) Prior Publication Data

US 2003/0021387 A1 Jan. 30, 2003

(30) Foreign Application Priority Data

Jul. 25, 2001 (JP) ..... 2001-224414
Jul. 15, 2002 (JP) ..... 2002-205664

(51) Int. Cl.[7] ..... H01J 1/62
(52) U.S. Cl. ..... 313/495; 313/582
(58) Field of Search ..... 313/495–497, 313/582–587, 113

(56) References Cited

U.S. PATENT DOCUMENTS

| | | | | | |
|---|---|---|---|---|---|
| 5,124,614 | A | | 6/1992 | Bakker et al. | 313/479 |
| 5,285,061 | A | * | 2/1994 | She et al. | 313/542 |
| 5,975,975 | A | * | 11/1999 | Hofmann et al. | 445/24 |
| 6,390,874 | B2 | * | 5/2002 | Mizutani et al. | 313/505 |
| 6,522,069 | B1 | * | 2/2003 | Hong et al. | 313/582 |
| 6,541,900 | B1 | * | 4/2003 | Ando | 313/495 |

FOREIGN PATENT DOCUMENTS

| | | |
|---|---|---|
| JP | 64-31332 | 2/1989 |
| JP | 3-165421 | 7/1991 |
| JP | 3-261026 | 11/1991 |
| JP | 7-326311 | 12/1995 |

* cited by examiner

*Primary Examiner*—Joseph Williams
(74) *Attorney, Agent, or Firm*—Fitzpatrick, Cella, Harper & Scinto

(57) ABSTRACT

An image display device where a substrate with a thickness of not more than 2 mm is used as a rear substrate, or where a low alkali glass substrate with an X-ray shielding member is used as a rear substrate.

19 Claims, 1 Drawing Sheet

LIGHT WEIGHT FLAT PANEL IMAGE DISPLAY DEVICE

BACKGROUND OF THE INVENTION

1. Field of the Invention

The present invention relates to a flat type image display device that displays images by exciting fluorescent members to emit light.

2. Description of the Related Art

In recent years, with the increase of the screen sizes of image display devices, light and thin "flat panel displays" are gaining popularity in place of deep and heavy Braun tubes (cathode ray tubes; hereinafter "CRTs"). Examples of the flat panel displays of which research and development are being actively pursued, include liquid crystal displays (hereinafter "LCDs") and plasma display panel (hereinafter "PDPs"). However, the images provided by conventional LCDs are dark and may be viewed head on or at only very small angles. The images provided by PDPs have low contrast. Accordingly, the demand is growing for a flat panel display that is as bright, as high in contrast, and as large in view angle, as the conventional CRT, and that can meet the request for the increasing of the screen size and the realization of high definition.

To respond the above-described demand, self-luminous flat panel displays, which cause fluorescent members to emit light using electronic rays as in the case of the conventional CRT, are also under development. In one such system, surface-conduction electron emitters (hereinafter "SCEs"), each of which is one kind of cold cathode, are arranged as a matrix on a glass substrate instead of the conventional hot cathode used in the conventional CRT, has been proposed by the same assignee as the present application, in Japanese Patent Laid-Open Nos. 64-031332, 7-326311 and the like.

FIG. 2 is a cut-away-perspective view schematically showing a constructional example of a flat panel display using these SCEs, namely, a surface-conduction electron emitter display (hereinafter "SED"). In FIG. 2, a front substrate (or a "face plate") 10 for displaying images comprises fluorescent members 12, a metal back 13, and a high-voltage terminal 3 each formed on a glass substrate 11. On the other hand, a rear substrate (or a "rear plate") 20 comprises two-dimensionally arranged SCEs 22 each formed on a glass substrate 21, and X wiring 23 and Y wiring 24 for driving the SCE 22. The front substrate 10 and the rear substrate 20 face each other, and are separated a predetermined distance therebetween by sandwiching support frames 2. Then these two plates are sealed up, and air is removed, thereby forming a vacuum case 1. On the rear surface side of the vacuum case 1, there is provided a drive circuit 4 including an IC group for driving the two-dimensionally arranged SCEs. The vacuum case 1 and the drive circuit 4 together constitute the above-mentioned SED.

An electron emitted from an SCE 22 used as a cold cathode is accelerated toward the metal back 13 used as an anode, and excites the adjacent fluorescent members 12 to emit light. To excite the fluorescent members 12 in this way, it is necessary to accelerate the electron used for excitation up to approximately 10 keV or higher. Currently, to increase the brightness of an image, one could increase the acceleration voltage or the current of the electron beam. However, when either the acceleration voltage or the current of the electron beam is increased, the amount of X-ray radiation generated by the impact of the accelerated electron against the fluorescent members also increases. In addition, because the surface of the vacuum case 1 is made of a transparent component member such as a glass substrate 11, or the like to allow for the output of the light beams emitted by the fluorescent members 12, the quantity of X-rays that cannot be absorbed by the transparent component member are radiated to the outside as leakage X-rays.

The International Commission on Radiological Protection (ICRP) states in its recommendations that any apparatus that includes a portion where electrons are accelerated by an energy not lower than 5 kV should be considered as a potential ionizing radiation source, and that any television set that is used at a home or at a place that the public can approach, should not make a leakage excessing 0.5 mR/h at any easily-approachable point 5 cm distant from the surface of the set when the set is operating in a normal operating condition. Accordingly, in order to meet this criterion, X-rays should be blocked on the front side of the face plate in the vacuum case 1, as a matter of course. In addition, because it is desirable to sufficiently block X-rays leaked from the rear plate 20 side in the vacuum case 1, when utilizing an SED as a television set or a display set, a display drive circuit comprising integrated circuits (hereinafter "ICs") is often placed inside an enclosure at the back of the rear plate 20 in the vacuum case 1 (i.e., on the opposite side of the face plate). Meanwhile, Japanese Patent Laid-Open No. 3-165421 discloses the arrangement that uses Ba, Zr, Sr, or Pb as an X-ray absorbing film in a display tube such as a CRT. Also, Japanese Patent Laid-Open No. 3-261026 discloses the arrangement where copper is disposed on the back surface of the rear plate as a heat radiation member.

SUMMARY OF THE INVENTION

According to a first aspect, the present invention provides an image display device that emits display light from the front surface thereof. This image display device comprises a front substrate 11; a rear substrate 21 with a thickness of not more than 2 mm; and an X-ray shielding member, e.g., an X-ray absorbing layer 25 that shields the rear substrate side. In the present invention, the rear substrate 20 is preferably thinner than the front substrate 10.

Preferably, the X-ray shielding member comprises a material with an X-ray absorption efficiency per unit weight higher than that of the material for the rear substrate. For example, it is preferable that a substrate comprising an insulative glass material be used as the rear substrate, and that the X-ray shielding member be formed from a material with an X-ray absorption efficiency per unit weight higher than that of the glass material.

The X-ray shielding member preferably comprises a material containing a non-radioactive heavy metal. In particular, it is preferable that a heavy metal selected from the group consisting of iron, lead, gold, silver, copper, platinum, tungsten, tantalum, and molybdenum.

Preferably, the present image display device comprises electron sources and an accelerating electrode that applies a potential that accelerates the electrons emitted from the electron sources. In particular, the potential applied to the accelerating electrode is preferably higher than the potential provided to the electron sources for electron emission by 5 kV or more. It is preferable that the accelerating electrode be provided on the front substrate, and that the electron emitters be provided on the rear substrate.

For displaying images, it is preferable to use a light-emitting material, which emits light when hit with electrons. Specifically, fluorescent members can be employed as the light-emitting material. The light-emitting material is preferably disposed on the front substrate. It is preferable that the front substrate and the rear substrate be each substantially planar. Also, preferably, both the front and rear substrates are substantially planar and simultaneously they are opposed to each other substantially in parallel.

Preferably, the X-ray shielding member should be arranged so that the orthogonal projection of the X-ray shielding member onto the rear substrate substantially covers approximately the entire surface of the rear substrate (80% or more of the area of the interior surface of the rear substrate). The X-ray shielding member may be a sheet-like configuration. The X-ray shielding member may have either a construction that maintains its form by itself without the need to be adhered to the rear substrate, or a construction that requires it to be adhered to the rear substrate by a method such as the vapor deposition.

In the present invention, it is preferable that there is a circuit for driving the image display device. This circuit is formed on the interior surface of the front substrate 11. In addition, the X-ray shielding member is located between the rear substrate and the above-described circuit.

According to a second aspect, the present invention provides an image display device that emits display light from the front surface thereof. This image display device comprises a front substrate; a rear substrate comprising a low alkali glass; and an X-ray shielding member that shields the rear substrate.

Further objects, features and advantages of the present invention will become apparent from the following description of the preferred embodiments with reference to the attached drawings.

DESCRIPTION OF THE PREFERRED EMBODIMENTS

Figure 1:
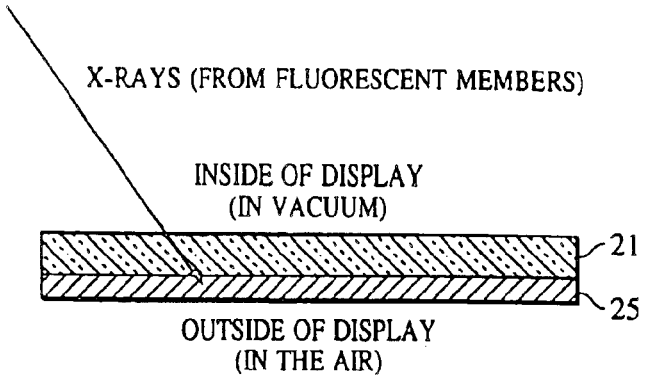
FIG. 1 is a sectional view showing an example of an image display device according to the present invention, where the structure of an X-ray absorption layer provided on a rear substrate in a vacuum case constituting a SED type flat panel display is schematically illustrated.

Below, a display using surface-conduction electron emitters as display elements will be described generally. Because X-rays can be attenuated by increasing the thickness of the glass substrate (rear substrate) 21 constituting the rear plate 20 of a SED type flat panel display, the above-described leakage X-rays from the rear plate side in the vacuum case can be inhibited. However, as flat panel screen size increases, using thick substrate glass not only for the front substrate 11 but also for the rear substrate 21 adds weight to the flat panel display. Therefore, at least with respect to the rear plate 20 in the vacuum case 1, there is a demand for using a glass substrate that is as thin as possible. Also, there is a demand for adopting a low alkali glass including a non-alkali glass as a rear substrate.

The embodiment described below addresses these problems. For example, in a SED type flat panel display, even when the brightness is enhanced by increasing the acceleration voltage or the current of the electron beam that excites the fluorescent members, the present embodiment makes it possible to reduce the amount of leakage X-rays from the panel rear surface to an acceptable level. Simultaneously, this embodiment makes it possible to reduce the thickness of the substrate glass of the rear plate 20 where the SCE 22 is provided to 2 mm or less, thereby reducing the weight of a flat panel display. Specifically, this embodiment has is arranged so that a lightweight X-ray adsorbing means to prevent the outward leakage of X-rays is provided on the rear substrate 20.

To arrive at a preferable embodiment capable of solving the above-described problems, the present inventors recognized that the front surface of the display panel requires translucence while the rear surface thereof require no translucence. Therefore, a glass need not be used for shielding the rear substrate side of the display from X-rays. However, because the interior surface of the rear substrate 20 is where the SCEs are formed, it is desirable for the surface to be insulative to the extent such that each of the SCEs 22 can be controlled independently, and hence, it is preferable to use a glass material for the surface of the rear substrate.

Further investigations produced findings that, it is preferable that the rear surface side has a glass material substrate portion, which has a thickness of 2 mm or less, and which is utilized for forming the electron emitters, and an X-ray shielding material layer portion using a material with an X-ray shielding ratio much higher than that of such a glass material. Based on the above-described observations, the present inventors have confirmed that, by providing an X-ray absorbing layer on the outer surface of the rear substrate constituting the vacuum case, composed of a material having an X-ray shielding ratio much higher than that of the glass material, it is possible to reduce the overall X-ray leakage quantity while using a substrate composed of an insulative material such as glass with a thickness of 2 mm or less.

Moreover, the present inventors have found that, by using an X-ray shielding member on the rear surface side with a low alkali glass substrate including a non-alkali glass substrate instead of soda-lime glass also effectively blocks X-rays. Here, the low alkali glass refers to glass in which the sum of the contents of $Na_2O$, $LiO_2$, and $K_2O$ contained is not more than 1 mol %.

The image display device is a kind of flat panel display that applies display light beams from the front surface. In a self-luminous flat panel display that emits light by being excited by electron beam irradiation, the front substrate 11 side taking out display light needs to use a substrate made from a translucent material while the material used for the rear substrate 21 does not need to be translucence. The image display device according to the present invention is arranged so that the entire outer surface of the rear substrate is effectively shielded by covering it with an X-ray absorbing layer made of a material having an X-ray shielding ratio much higher than that of the glass material, thereby effectively blocking X-rays generated by the fluorescent members irradiated with electron beams.

The embodiment according the present invention will be described in more detail below.

Figure 2:
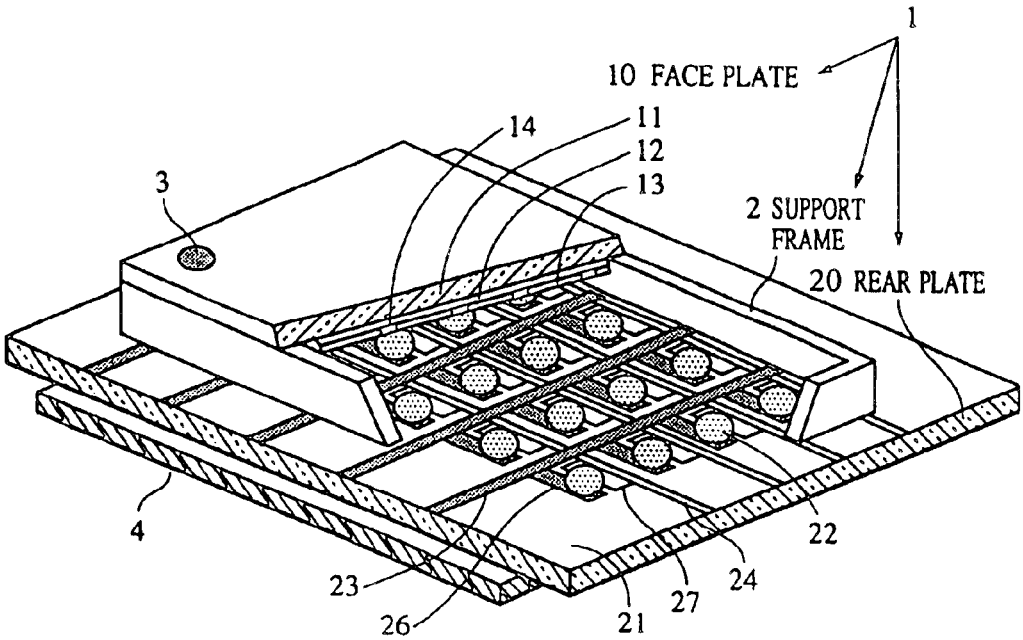
FIG. 2 is a perspective view showing a constructional example of a flat panel display using a conventional SCE, where the internal structure thereof is schematically illustrated.

FIG. 1 is a cross sectional view of an enlarged partial section of the rear plate 20 including an X-ray absorbing layer 25 covering the entire outer surface of the rear substrate 21, found in an embodiment of the present invention. FIG. 2 is a cut-away view of an SED type panel display. In FIG. 1, electron emitters 22, X wiring 23, Y wiring 24, which are formed on the surface on the vacuum side of the rear substrate 21, are omitted from illustration.

The X-ray absorbing layer 25 depicted in FIG. 1 is an iron sheet. The iron sheet is laminated with a plastic film to protect the iron sheet from corrosion. In FIG. 1, this thin film coat is omitted from illustration. At the rear plate 20 where the electron emitters 22, X wiring 23, Y wiring 24 and the like are formed, a glass substrate 21, made from commonly used soda-lime glass, which is in common use, is employed. In a conventional device, the glass substrate 21 is thick enough to sufficiently block X-rays by itself. In comparison, in the present invention as shown in FIG. 1, an iron sheet with a thickness of 100 $\mu$m is used in conjunction with a glass substrate 21 with a thickness of 1.4 mm, which is only one half the conventional thickness of the glass substrate. In FIG. 1, for the sake of illustration, the iron sheet 25 is represented with an exaggerated thickness as compared to the thickness of the glass substrate 21.

It is desirable for the acceleration voltage of electronic beams for exciting the fluorescent members to emit light, to be higher in order to obtain bright images. However, an increase of the acceleration voltage enhances the electric field between the electron emitting elements 22 and the face plate 10, thereby increasing the possibility of generating electric discharge. A possible method for reducing the electric field is to enlarge the distance between the rear plate 20 comprising the electron emitting elements 22 and the face plate 10. However, this undesirably brings about the increase in size of the display. It is, therefore, preferable for the acceleration voltage to be 20 kV or less. If photon energy of the X-rays to be shielded is assumed to be 20 keV, the attenuation values per 1 mm of the thicknesses of the soda-lime glass and the iron are approximately 3.3 dB and 85 dB, respectively, and the densities of the soda-lime glass and the iron are approximately 2.5 g/cm$^3$ and 7.68 g/cm$^3$, respectively. Therefore, in the case where the above-described iron sheet with a thickness of 100 $\mu$m is used with the glass substrate 21 with the reduced thickness, the X-ray attenuation value increases by 3.88 dB as a whole, as compared to the case of the conventional structure where the thickness of the glass substrate 21 is double that of this embodiment. On the other hand, the sum of weight of the glass substrate and the iron sheet is 39% less than the weight of the conventional structure, which uses only a soda lime glass which is twice as thick as the glass substrate 21 use in the present invention.

The present invention is not limited to the above-described embodiment. Alternative material may be used as the layer 25. Such other material that might be used should have a high X-ray absorbing efficiency per unit weight in a uniform sheet so as to produce a higher X-ray shielding effect while realizing the reduction in weight, as in the case of the above-described embodiment. It is also desirable that the material for the X-ray absorbing layer 25 is selected from among materials other than materials emitting radiation. A material that meets these conditions and that can be easily worked into a sheet with a uniform thickness is suitable for the X-ray absorbing layer 25. The above-described iron is one of the suitable materials.

Other than iron, use of a non-radioactive heavy metal having an X-ray absorbing effect, such as lead, gold, silver, copper, platinum, tungsten, tantalum, molybdenum or the like provides an equivalent effect to that of iron. In addition, the X-ray absorbing effect occurs when the heavy metal is mixed with another substance. Therefore, when a substance includes a heavy metal of the type listed above (e.g., lead glass or the like), the substance exerts an X-ray absorbing effect according to the content of the heavy metal atoms contained therein. Thus, a substance including a heavy metal may be employed as a material for an X-ray absorbing layer. For example, when using lead glass containing 25% lead by weight as an X-ray absorbing layer, the attenuation value per 1 mm of the thickness of the lead glass with respect to the X-rays with 20 kV is 28 dB, and the density thereof is approximately 3.5 g/cm$^2$, and hence, addition of lead glass with a thickness of 1 mm as an X-ray adsorbing layer 25 to the rear substrate with a thickness of 1 mm would allow the X-ray attenuation value to be increased by 22 dB. Additionally, the weight of the flat screen monitor would be reduced by 14%, as compared to the case of the X-ray absorbing layer 25 made from conventional soda lime glass with a thickness of 2.8 mm. Because the X-ray attenuation value is sufficiently high, the thickness of the lead glass may be reduced to further reduce the overall weight of the display. However, given the increasing sizes of displays, caution must be exercised when designing displays containing thin lead glass.

For the rear substrate 21 itself, common glass including soda-lime glass can be used. Also, as an X-ray absorbing layer 25, a thin film such as metallic evaporated film with a desired thickness, can also be used. Furthermore, in some cases, it is also possible to combine more than one of the X-ray absorbing layers as described above to form a single X-ray absorbing layer 25.

On the other hand, the structure of the flat panel display itself is such that the front substrate (glass substrate) 11 and the rear substrate 21 are sealed up with the support frame 2 therebetween, as in the case of the conventional structure shown in FIG. 2. For the front substrate 11 itself, a common glass substrate 11 that is translucent and insulative, such as soda-lime glass, is used. The thickness of the glass substrate 11 must sufficiently meet the above-described criterion of leakage X-ray dose, and must be within the range meeting the mechanical strength required of the vacuum case 1. On the inner surface of the glass substrate 11, there are provided layers of fluorescent members 12 and a metal back 13 formed on the inner surface of the glass substrate 11, and the metal back 13 is connected to the high voltage terminal 3 for applying a high voltage to the metal back 13.

On the other hand, for the rear substrate 20 itself, a glass substrate 21 that is insulative, such as soda-lime glass, is used. The glass substrate 21 has an X-ray absorbing layer 25 formed on the outer surface thereof to inhibit an X-ray leakage, and therefore, although the thickness thereof is made significantly thinner than that of the glass substrate 11 for the front substrate, the thickness thereof is selected to provide mechanical strength required by the vacuum case 1.

On the inner surface of the glass substrate 21, a cold electrode that is used as an electron beam source for exciting the fluorescent members 12 by electron beam irradiation, is provided. For example, SCEs are formed into a two-dimensional array corresponding to the matrix of the planar display. Specifically, the SCEs 22 are each formed between an X-wiring electron emitter electrode 26 and a Y-wiring electron emitter electrode 27 that are connected to the X wiring 23 and Y wiring 24, respectively, and are two-dimensionally arranged to form a matrix. The drive circuit 4 selects one of the SCEs 22 by selecting one X wiring and one Y wiring, thereby causing a high voltage to be applied across this electron emitter 22 and the metal back 13, whereby electrons are emitted and accelerated to irradiate the fluorescent members 12. The drive circuit 4, which controls current supply through the X wiring and the Y wiring, is located on the outside surface of the rear substrate 21.

The drive circuit 4 is a circuit comprising semiconductor elements, and therefore, if this circuit is subjected to excessive X-ray irradiation for a long period of time, it will malfunction and/or individual elements used in the drive circuit 4 may fail. In the image display device according to the present invention, X-ray leakage is effectively inhibited by the X-ray absorbing layer 25 provided on the outer surface of the rear substrate 21, and hence, even though more X-rays are created when the acceleration voltage or the current of the electron beams is increased, it is possible to mount the drive circuit 4 on the display panel in close proximity, without the above-described malfunction due to the leakage X-rays resulting.

Below, a more specific description of the present invention will be made taking the given embodiment thereof as an example.

The SED to which the present invention relates is explained below.

First, the method for producing the rear plate 20 will be described. The material selected for the glass substrate 21 for the rear plate 20 is soda-lime glass with a thickness of 1.4 mm. In addition, a $SiO_2$ film with a thickness of 100 nm is applied to the glass substrate 21 and baked to form a sodium block layer thereover. The X-wiring electron emitter electrodes 26 and the Y-wiring electron emitter electrodes 27 are produced by the following method. First, a titanium film with a thickness of 5 nm is formed as an undercoat layer. Then a platinum film with a thickness of 40 nm is formed thereover using a sputtering method. Thereafter, a photoresist is applied thereto, and then patterning is performed by a series of photolithographic processes such as exposure, development, and etching.

Next, the X wiring 23 and the Y wiring 24 are formed in a two-dimensional matrix arrangements. The matrix is formed by (1) printing the Y wiring, (2) adding an insulating layer on top of the Y wiring, and (3) printing the X wiring.

First, the Y wiring 24 is formed in linear patterns so as to make contact the Y wiring electron emitter electrodes 27. For this purpose, screen printing is performed using silver photo paste ink for the Y wiring material, and after drying, predetermined patterns are obtained by an exposure and a development processes. Thereafter, the photo paste ink is baked at a temperature of 480° C. to form the Y wiring. The Y wiring has a thickness of approximately 10 $\mu$m and a width of 50 $\mu$m. The end portion of each line of the Y wiring is made larger in the line width, in order to facilitate connection to external circuitry.

Next, to insulate the X wiring and the Y wiring from each other, interlayer insulating layers are provided to cover the Y wiring 24. In this case, the interlayer insulating layers were formed below the X wiring 23 so as to cover the crossing portions between the X wiring 23 and the previously formed Y wiring 24. Also, when the interlayer insulating layers are formed, contact holes are provided at the intersection of the X-wiring electron emitter electrodes 26 and the insulating layer so that the X-wiring electron emitter electrodes 26 can be electrically connected to the X wiring 23. In the formation process of the interlayer insulating layers, after a photosensitive glass paste, which contains PbO as its main ingredient, is subjected to screen printing, an exposure and a development are performed. This process is repeated four times, and then the rear substrate 21 with the photo-sensitive glass paste on top is baked at 480° C. The overall thickness of the interlayer insulating layer is approximately 30 $\mu$m and the width thereof is 150 $\mu$m.

Finally, the X wiring 23 is formed by the following method. First, silver paste is screen-printed on the interlayer insulating layers previously formed. After drying, the same operation is performed again. Finally, a baking treatment is performed at 480° C. The X wiring 23 intersects the Y wiring 24 with the interlayer insulating layers therebetween. At the contact holes, which were previously formed in the interlayer insulating layers at an above step, the X wiring 23 is connected to the X-wiring electron emitter electrodes 26, which already had been formed on the glass substrate 21 as described above.

After the formation process of the X-Y matrix wiring 23 and 24 have been completed, with respect to the electron emitter electrodes 26 and 27, which are connected to the X wiring 23 and the Y wiring 24, respectively, SCEs (electron emitter films) 22 are applied therebetween by an ink jet method. After a panel forming process, the X-Y matrix wiring 23 and 24 are operable as scanning electrodes with respect to the two-dimensionally arranged SCEs. For electron emitter films for the SCEs 22, an organic palladium-containing solution obtained by dissolving a palladium-proline complex 0.15 wt % into aqueous solution consisting of water 85: isopropyl alcohol (IPA) 15, is used. Then, by baking the glass substrate applied with this organic palladium films in the air at 350° C. for 10 min, palladium oxide (PdO) is obtained. The diameter of the electron emitter film is approximately 60 $\mu$m, and the thickness thereof is 10 nm at the maximum. With respect to the electron emitter films formed on the rear plate by a baking treatment, a process designated as "forming" where the electron emitter films have cracks generated in the insides thereof by performing an energizing process in a reducing atmosphere, and thereby electron emitter portions are formed, is performed. Furthermore, by performing a process designated as "activation" where an energizing treatment is performed under a suitable degree of vacuum where organic compounds exist, and by performing carbon accumulating process with respect to the cracks generated in the forming process, the electron emitter films are transformed into states usable as electron sources.

Now, the method for producing the front plate 10 will be described. As in the case of a conventional front substrate 11, fluorescent members 12 representing the primary colors and a black conductive material 14 designated as "black stripes" β formed therebetween, are disposed on the glass substrate 11. Then the metal back 13 made of aluminum is vapor-deposited on the surface of the front substrate 10, on top of the fluorescent members 12 and the black stripes. The vacuum case 1 is formed by sandwiching the support frames 2 between the face plate 10 and the rear plate 20, and sealing them in a vacuum at a temperature of approximately 400° C. As sealing material, frit glass is employed. By evacuating the inside of the vacuum case 1 using an exhaust pipe (not shown) affixed to the face plate, and by sealing the vacuum case, a display panel of which the inside is maintained in a vacuum, is formed.

After the above-described display panel forming process, an iron sheet 25 is adhered over the entire outer surface of the rear plate 20, so as not to leave any gap. Because iron is prone to rust when exposed to air, the iron sheet used is laminated with a plastic film. In FIG. 1, the detailed structure of the iron sheet is omitted from illustration. The thickness of the iron sheet used is 100 $\mu$m. After the iron sheet has been adhered to the outer surface of the rear substrate 21, the display panel with the iron sheet adhered on the rear surface is affixed to the enclosure including the drive circuit 4, and is finished into a state allowing image display.

The shielding effect of the iron sheet against X-rays is equivalent to soda-lime glass having a thickness of 2.6 mm. In the display panel in this embodiment, the dose of X-rays leaked from the rear surface is approximately 40% of the dose of X-rays leaked from a conventional soda-lime glass with a thickness of 2.8 mm. The bulk density of the soda-lime glass with a thickness of 1.4 mm is 2.5 g/cm$^3$ per unit area. On the other hand, while the bulk density of the iron sheet used in the present embodiment is 7.68 g/cm$^3$, use of the iron sheet in the present display panel with an area of 0.75 m$^2$, reduces the weight of the display panel by approximately 2 kg. In order to obtain a further weight reduction effect, it is possible to use a thinner glass substrate. However, when attempting to apply the glass substrate to a large screen display, it is preferable that the glass substrate has a thickness of 0.7 mm or more, from the viewpoint of the flatness and strength of the glass substrate.

In the above-described embodiment, soda-lime glass was used as the glass substrate 21. Alternatively, however, a low alkali glass can be used in place of the soda-lime glass, when it is used in conjunction with an additional X-ray shielding material.

The image display device in the above-described embodiment has an arrangement such that, in the flat panel display using SCEs 22, an X-ray absorbing layer 25 is provided on the outer surface of the rear substrate 20, to inhibit X-rays, which are generated by exciting the fluorescent members 12 provided on the front substrate 11 with accelerated electrons, from leaking through the rear substrate 20. Therefore, even if the thickness of the rear substrate 20 is made 2 mm or less, or a low alkali glass is used, a sufficiently high X-ray shielding effect can be achieved. Hence, in order to obtain a high brightness, even when an acceleration voltage of the electron beams exciting the fluorescent members is increased (specifically, when a potential higher than that of the SCEs 22 by 5 kV or more is used) or the current is increased, it is possible for the X-ray absorbing layer 25 provided on the outer surface of the rear substrate 21 to efficiently absorb the X-ray dose, which will proportionally increase with the increase of the electron beam. This enables the dose of X-ray leakage from the rear substrate to be maintained at a level where human bodies and the drive circuit including semiconductor elements are not adversely effected. Simultaneously, the overall thickness of the flat panel display including the X-ray absorbing layer provided on the outer surface thereof can be reduced, and the weight thereof can also be saved. Thus, even in a large size screen, it is possible to produce a light, thin flat panel display having a high brightness and a superior contrast.

In the above-described examples, an arrangement using surface-conduction electron emitters as electron sources has been disclosed. However, the present invention is not limited to this arrangement. Different types of electron emitters can also be used. Also, the present invention is not restricted to a display device that emits light by directly applying electrons to a light-emitting material. The present invention can also be applied to different display devices such as ones that generate ultraviolet rays and thereby cause a light-emitting material to emit light.

As is evident from the foregoing, the present invention allows a preferable image display device to be implemented.

While the present invention has been described with reference to what are presently considered to be the preferred embodiments, it is to be understood that the invention is not limited to the disclosed embodiments. On the contrary, the present invention is intended to cover various modifications and equivalent arrangements included within the spirit and scope of the appended claims. The scope of following claims is to be accorded the broadest interpretation so as to encompass all such modifications and equivalent structures and functions.

What is claimed is:

1. An apparatus, comprising:

an image display device that emits display light from a front surface, the image display device including:

a front substrate;

a rear substrate having a thickness not more than 2 mm;

an electron source arranged on the rear substrate, wherein said electron source comprises a plurality of electron emitting devices and a plurality of wirings for wiring the plurality of electron emitting devices; and a light emitting material which emits light when hit with electrons from the electron source;

a circuit for driving the image display device, the circuit being formed on an opposite side of the rear substrate from the front substrate; and an X-ray shielding member located between the rear substrate and the circuit.

2. An apparatus according to claim 1, wherein the X-ray shielding member comprises a material that has an X-ray absorption efficiency per unit weight higher than that of the material for the rear substrate.

3. An apparatus according to claim 1, wherein the X-ray shielding member comprises a material containing a non-radioactive heavy metal.

4. An apparatus according to claim 1, wherein the X-ray shielding member comprises a material containing at least a heavy metal selected from the group consisting of iron, lead, gold, silver, copper, platinum, tungsten, tantalum, and molybdenum.

5. An apparatus according to claim 1, wherein the rear substrate is thinner than the front substrate.

6. An apparatus according to claim 1, further comprising:

an accelerating electrode to which a potential that accelerates electrons emitted from the electron source, is applied, wherein the potential is higher than the potential provided to the electron sources for electron emission by 5 kV or more.

7. An apparatus according to claim 6, wherein the accelerating electrode is provided on the front substrate.

8. An apparatus according to claim 1, wherein the X-ray shielding member is provided so that the orthogonal projection of the X-ray shielding member onto the rear substrate substantially covers approximately the entire surface of the rear substrate.

9. An apparatus comprising:

an image display device that emits display light from a front surface, the image display device including:

a front substrate;

a rear substrate comprising a low alkali glass;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a circuit for driving the image display device, the circuit being formed on an opposite side of the rear substrate from the front substrate; and an X-ray shielding member which is located between the rear substrate and the circuit.

10. An apparatus according to claim 1, wherein the X-ray shielding member blocks X-rays radiated outwardly from the rear substrate side.

11. An apparatus according to claim 9, wherein the X-ray shielding member blocks X-rays radiated outwardly from the rear substrate side.

12. An apparatus according to claim 1, wherein the X-ray shielding member is provided on an outer surface of the rear substrate.

13. An apparatus according to claim 9, wherein the X-ray shielding member is provided on an outer surface of the rear substrate.

14. An apparatus comprising:

an image display device that emits display light from a front surface, the image display device including:

a front substrate;

a rear substrate having a thickness not more than 2 mm;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a circuit for driving the image display device, the circuit being formed on an opposite side of the rear substrate from the front substrate; and a member located between the rear substrate and the circuit, wherein the member comprises a material with an X-ray absorption efficiency per unit weight higher than that of material of the rear substrate.

15. An apparatus comprising:

an image display device that emits display light from a front surface, the image display device including:

a front substrate;

a rear substrate comprising a low alkali glass;

an electron source arranged on the rear substrate, wherein said electron source comprises a plurality of electron emitting devices and a plurality of wirings for wiring the plurality of electron emitting devices; and a light emitting material which emits light when hit with electrons from the electron source;

a circuit for driving the image display device, the circuit being formed on an opposite side of the rear substrate from the substrate; and a member located between the rear substrate and the circuit, wherein the member comprises a material that has an X-ray absorption efficiency per unit weight higher than that of material of the rear substrate.

16. An apparatus comprising:

an image display device that emits display light from a front surface, the image display device including:

a front substrate;

a rear substrate having a thickness not more than 2 mm;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a semiconductor circuit formed on an opposite side of the rear substrate from the front substrate; and an X-ray shielding member located between the rear substrate and the circuit.

17. An apparatus comprising:

an image display device that emits display light from a front surface, the image display device including:

a front substrate;

a rear substrate comprising a low alkali glass;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a semiconductor circuit formed on an opposite side of the rear substrate from the front substrate; and an X-ray shielding member which is located between the rear substrate and the circuit.

18. An apparatus comprising:

an image display device that emits display light from a front surface, the image display device including:

a front substrate;

a rear substrate having a thickness not more than 2 mm;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a semiconductor circuit formed on an opposite side of the rear substrate from the front substrate; and a member located between the rear substrate and the circuit, wherein the member comprises a material with an X-ray absorption efficiency per unit weight higher than that of material of the rear substrate.

19. An apparatus comprising:

an image display device that emits display light from a front surface, the image display device including:

a front substrate;

a rear substrate comprising a low alkali glass;

an electron source arranged on the rear substrate, wherein the electron source comprises a plurality of electron emitting devices and a plurality of wirings for wiring the plurality of electron emitting devices; and a light emitting material which emits light when hit with electrons from the electron source;

a semiconductor circuit formed on an opposite side of the rear substrate from the substrate; and a member located between the rear substrate and the circuit, wherein the member comprises a material that has an X-ray absorption efficiency per unit weight higher than that of material of the rear substrate.

* * * * *

UNITED STATES PATENT AND TRADEMARK OFFICE

CERTIFICATE OF CORRECTION

PATENT NO. : 6,943,492 B2
APPLICATION NO. : 10/200404
DATED : September 13, 2005
INVENTOR(S) : Tokutaka Miura et al.

It is certified that error appears in the above-identified patent and that said Letters Patent is hereby corrected as shown below:

COLUMN 4:

Line 47, "translucence." should read --translucent.--.

COLUMN 11:

Line 43, "substrate;" should read --front substrate;--.

COLUMN 12:

Line 53, "substrate;" should read --front substrate;--.

Signed and Sealed this

Eighteenth Day of July, 2006

JON W. DUDAS
*Director of the United States Patent and Trademark Office*